US008286790B1

(12) United States Patent
McBryar

(10) Patent No.: US 8,286,790 B1
(45) Date of Patent: Oct. 16, 2012

(54) PAINT BRUSH CLEANING AND CARRYING DEVICE

(76) Inventor: Rocky G. McBryar, Trenton, GA (US)

( * ) Notice: Subject to any disclaimer, the term of this patent is extended or adjusted under 35 U.S.C. 154(b) by 0 days.

(21) Appl. No.: 13/039,117

(22) Filed: Mar. 2, 2011

(51) Int. Cl.
*B65D 83/10* (2006.01)
*B65D 81/24* (2006.01)
*B08B 3/04* (2006.01)

(52) U.S. Cl. ..... 206/362; 15/104.92; 206/15.2; 206/209

(58) Field of Classification Search ..... 206/15.2, 206/15.3, 361, 362, 209; 15/4, 257.06, 104.92, 15/257.01
See application file for complete search history.

(56) References Cited

U.S. PATENT DOCUMENTS 1,373,766 A * 4/1921 Sather ..... 206/209
1,952,325 A * 3/1934 Looft ..... 206/209
1,979,241 A * 11/1934 Albanese et al. ..... 206/362
2,262,753 A * 11/1941 Brennan ..... 206/209
2,270,593 A * 1/1942 Kurath et al. ..... 206/209
2,479,509 A * 8/1949 Pichniarczyk ..... 206/362
2,646,808 A * 7/1953 Yenne ..... 206/209
3,392,417 A * 7/1968 Barnhill, III et al. ..... 15/257.05
3,696,457 A * 10/1972 Hand ..... 15/4
3,955,670 A * 5/1976 Buslik ..... 206/15.3
4,533,044 A 8/1985 Ban
5,007,553 A 4/1991 Curtis
5,097,967 A 3/1992 Sica
5,363,870 A * 11/1994 Doyon ..... 206/15.3
5,641,007 A 6/1997 Falk
5,791,534 A * 8/1998 Davis et al. ..... 206/362
7,383,948 B1 6/2008 Richardson
2004/0261819 A1 * 12/2004 Farnoush et al. ..... 15/104.92

* cited by examiner

*Primary Examiner* — Bryon Gehman

(57) ABSTRACT

The paint brush cleaning and carrying device provides the advantage of a vented transparent pail with brush viewing from the exterior. The sealable removable lid provides tubular brush handle holders, each handle holder twistable and having varied height multiple pairs of orifices. Removable pins pass through the orifices and through existing holes in existing paint brush handles to dangle the brushes downwardly into selectively disposed brush solvents. The lipped removable lid can be inverted and returned atop the pail for brush drainage without solvent loss.

9 Claims, 5 Drawing Sheets

PAINT BRUSH CLEANING AND CARRYING DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various devices exist for cleaning, drying, and transporting paint brushes whether individually and cumulatively. The present device solves problems apparent in previous devices. Some such problems are difficulty in transport, brush protection, brush visibility, ease of draining and drying brushes, balance, and device stackability. Also, some devices even require brush modifications for use.

FIELD OF THE INVENTION

The paint brush cleaning and carrying device relates to paint brushes, their cleaning, drainage, protection, and transport.

SUMMARY OF THE INVENTION

The general purpose of the paint brush cleaning and carrying device, described subsequently in greater detail, is to provide a paint brush cleaning and carrying device which has many novel features that result in an improved paint brush cleaning and carrying device which is not anticipated, rendered obvious, suggested, or even implied by prior art, either alone or in combination thereof.

To attain this, the paint brush cleaning and carrying device provides ideal advantages for ease of transport of multiple brushes. The device provides secure lid closures and a vented interior for brush drying. The transparent pail also provides brush visibility from the exterior. As brush protection is important, especially with the expense of professional brushes, the tubular holder and removable pins disposed therein prevent brushes from colliding with each other or with the pail interior. Further, and importantly, a portion of the pairs of orifices are disposed at varying heights within the tubular holders. This feature not only allows for brushes to be held at desired varied heights but also accommodates brushes with varying height holes in their handles. Collision protection and other choices are further provided by the features wherein the holders are twistable and oblong. The easily installed and removed pins require no brush modifications and securely fasten when fastening the brush handles within the tubular holders. Clevis pins, hitch pins, and the like may be used for removable brush retention. The easily removed and reversed lid with then upwardly disposed lip provides for the reversed lid to rest upon the pail and further allows brushes to drain and dry. The lipped lid catches brush drainage. The offset handle recess for the lid handle enables the pivotal handle to be centered upon upward pivot, thereby affording balanced carry of the device. The pivotally recessed handle also provides for stackability of the device, whether with more devices of the same or with other items. The removable tray with tray vents is disposed near the pail bottom. The tray substantially traps brush drainage against excessive slosh in transport. The pail vents allow brushes to dry more rapidly.

Thus has been broadly outlined the more important features of the improved paint brush cleaning and carrying device so that the detailed description thereof that follows may be better understood and in order that the present contribution to the art may be better appreciated.

An object of the paint brush cleaning and carrying device is to provide for simultaneous multiple brush cleaning.

Another object of the paint brush cleaning and carrying device is to provide for multiple brush carry.

Another object of the paint brush cleaning and carrying device is to ensure against paint brush damage.

A further object of the paint brush cleaning and carrying device is to provide for easy brush transport.

An added object of the paint brush cleaning and carrying device is to provide a pail for brush soaking and cleaning.

A further object of the paint brush cleaning and carrying device is to provide for easy pail drainage.

And, an object of the paint brush cleaning and carrying device is to provide a securely attachable lid.

Another object of the paint brush cleaning and carrying device is to provide a reversible lid.

A further object of the paint brush cleaning and carrying device is to provide for multiple brush draining and drying.

A further object of the paint brush cleaning and carrying device is to provide a well for brush drainage.

Another object of the paint brush cleaning and carrying device is to negate brush modifications for use with the device.

These together with additional objects, features and advantages of the improved paint brush cleaning and carrying device will be readily apparent to those of ordinary skill in the art upon reading the following detailed description of presently preferred, but nonetheless illustrative, embodiments of the improved paint brush cleaning and carrying device when taken in conjunction with the accompanying drawings.

DETAILED DESCRIPTION OF THE DRAWINGS

With reference now to the drawings, and in particular FIGS. 1 through 6 thereof, the principles and concepts of the paint brush cleaning and carrying device generally designated by the reference number 10 will be described.

Figure 1:
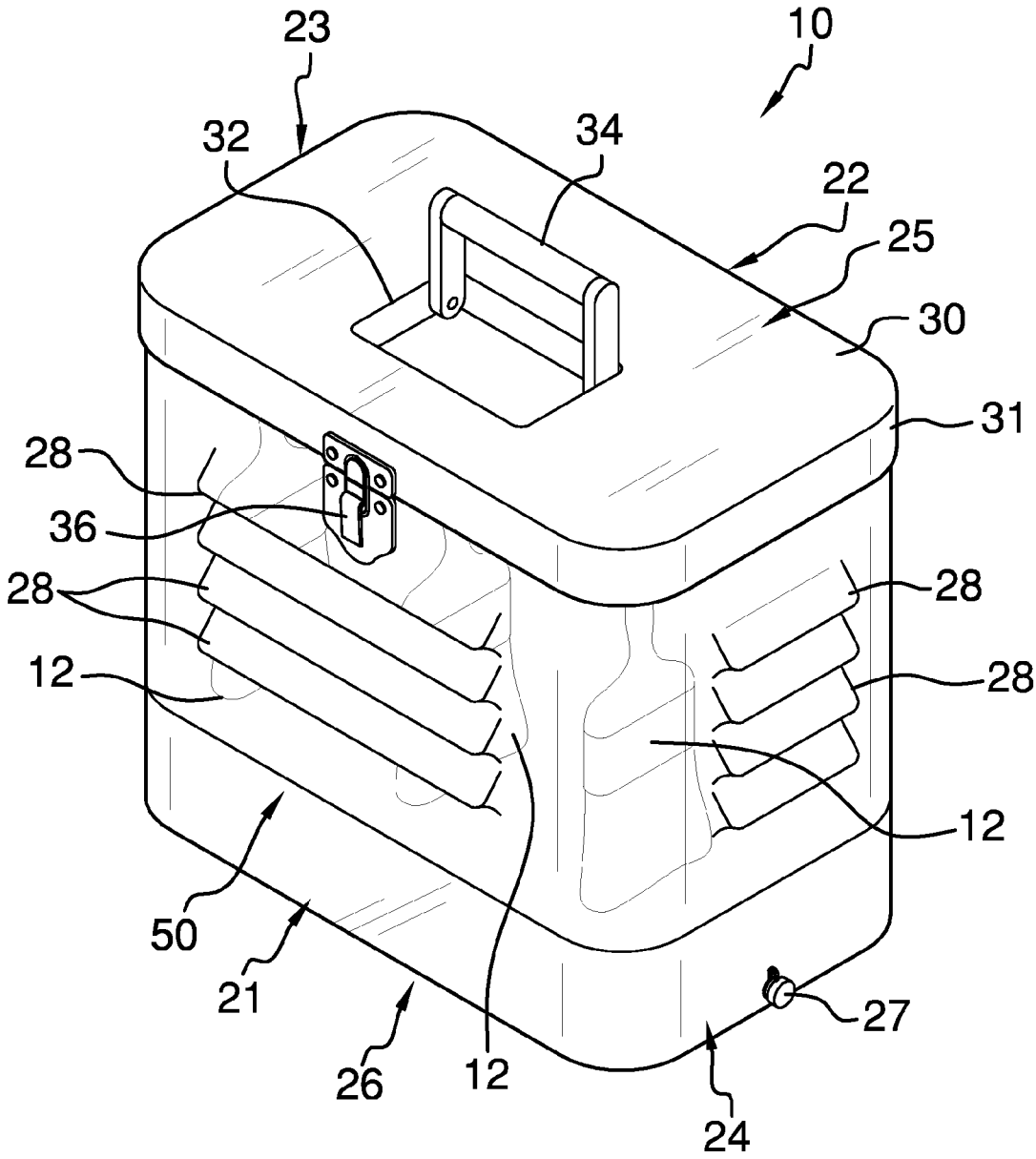
FIG. 1 is a top first side perspective view.

Referring to FIG. 1, the device 10 partially comprises the transparent pail 20 having a first side 21 spaced apart from a second side 22, a first end 23 spaced apart from a second end 24, and an open top 25 spaced apart from a closed bottom 26.

Figure 5:
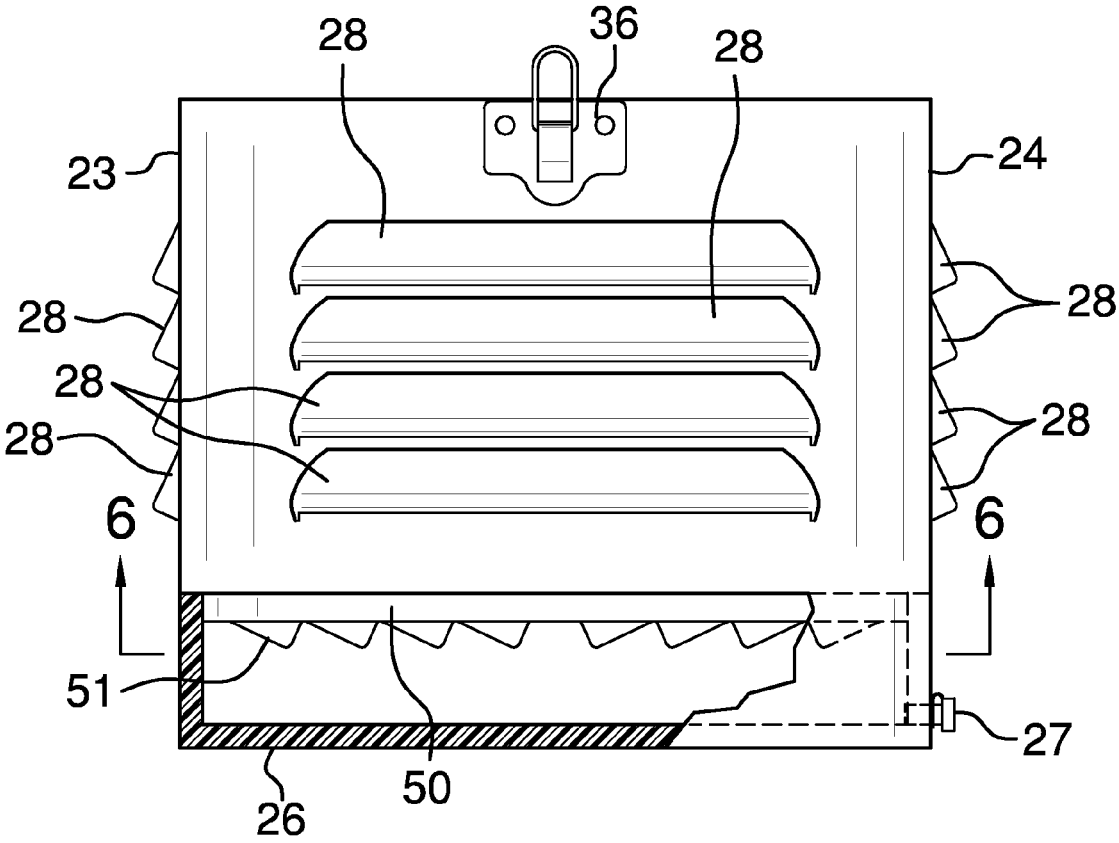
FIG. 5 is a first side partial cross sectional elevation view of the pail.

Referring to FIG. 5, the drain 27 is disposed adjacent to the bottom 26 on the pail 20 second end 24. The drain 27 location may vary from side to side and from end to end but is always immediately adjacent to the pail 20 bottom 26 to ensure complete drainage of the pail 20 as desired.

Figure 2:
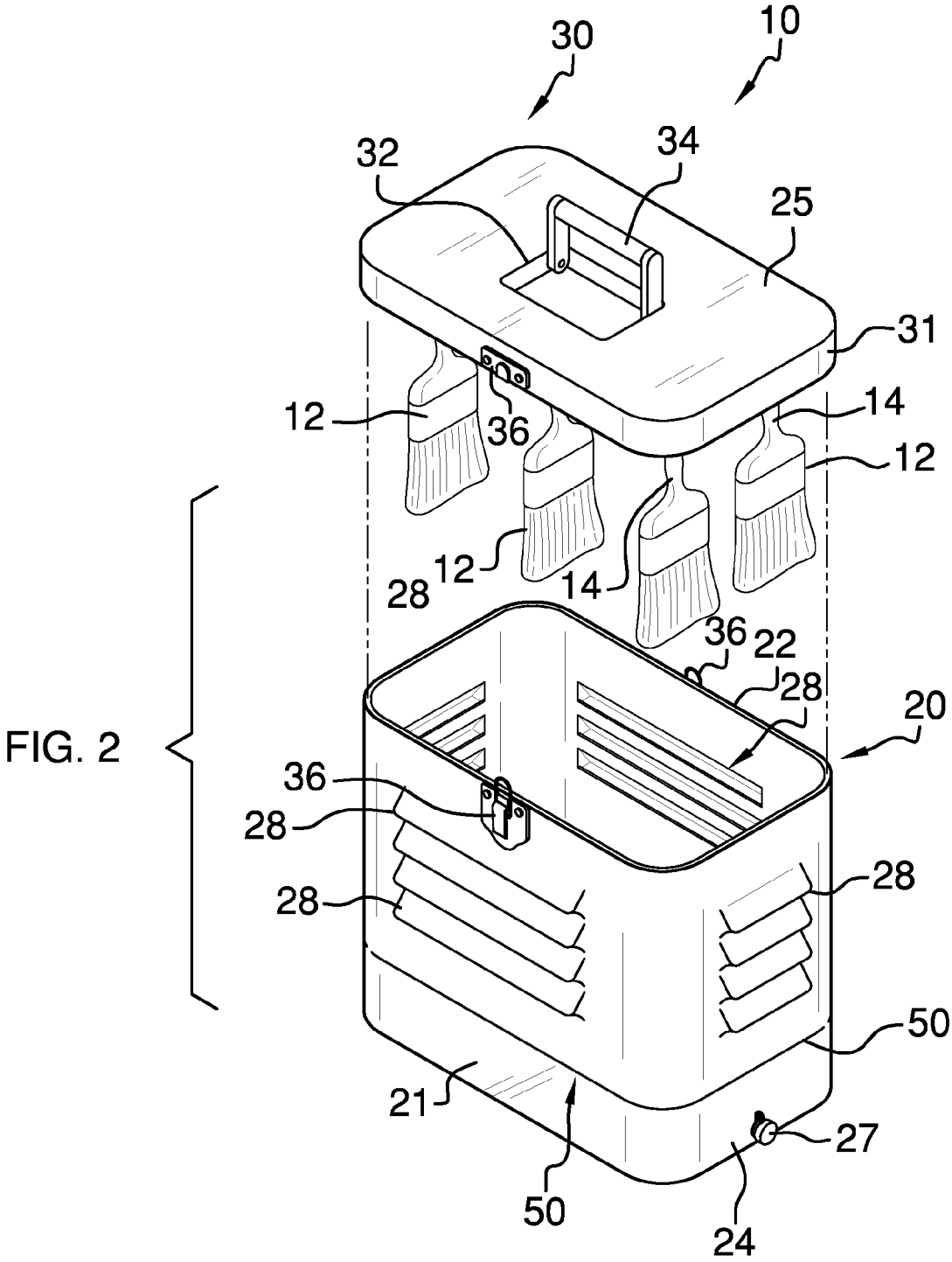
FIG. 2 is a top first side perspective view, lid removed and device in use.

Referring to FIG. 2, the lid 30 is removably fitted atop the pail 20. A lip 31 is extended around the lid 30. The plurality of vents 28 is disposed horizontally in each of the pail 20 sides.

Referring again to FIG. 1, the handle recess 32 is disposed substantially centrally within the lid 30 top 25. The handle recess 32 is slightly offset toward the first side 21. A pivotal handle 34 is disposed within the handle recess 32. The pivoting handle 34 is pivoted upwardly to a fully central position upon and above the lid 30.

Figure 4:
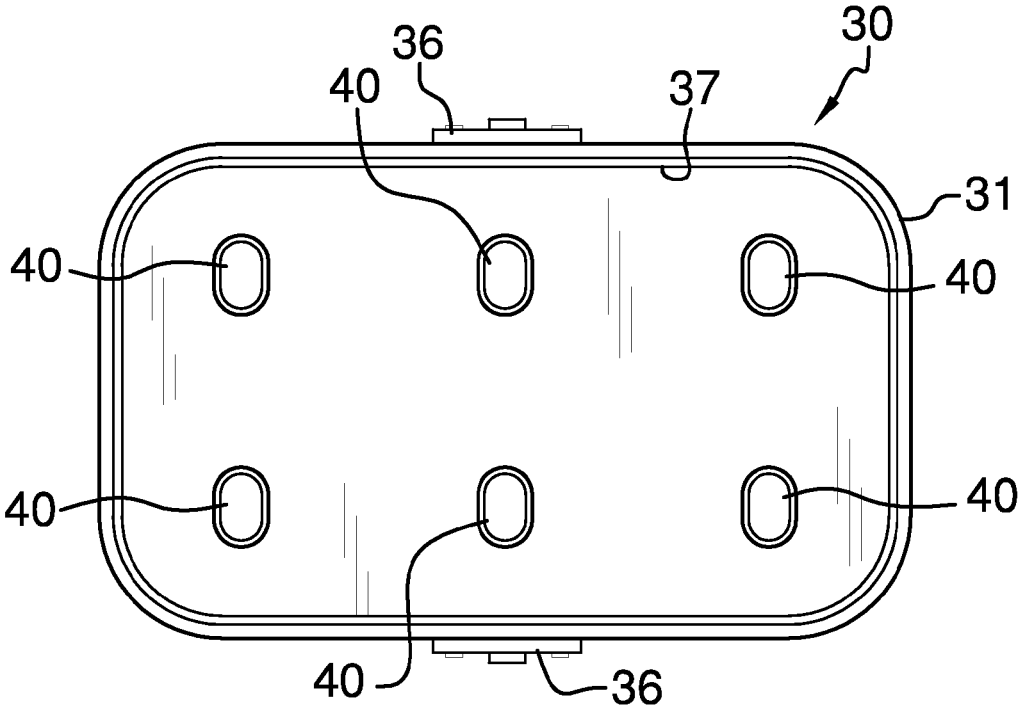
FIG. 4 is a bottom plan view of the lid.

Referring to FIG. 4, a seal 37 is disposed around an interior perimeter of the lip 31. A lid latch 36 is disposed on the pail 20 and a lid 30 first side 21. A lid latch 36 is disposed on the pail 20 and a lid 30 second side 22.

Figure 3:
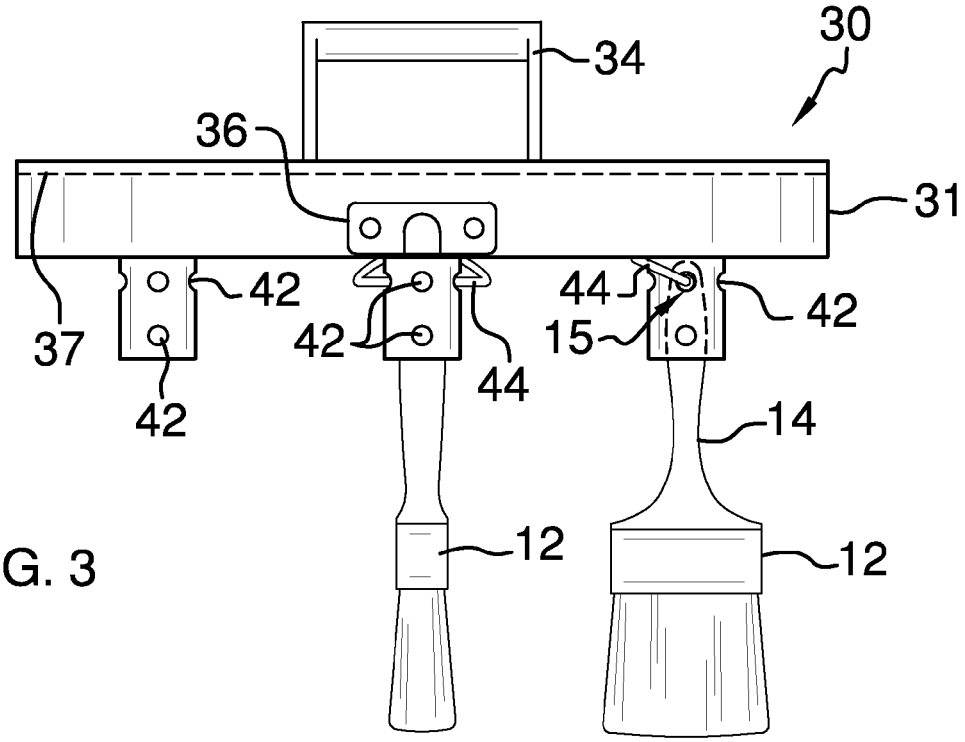
FIG. 3 is a first side lid elevation view, in use.

Referring to FIG. 3 and to FIG. 4, a plurality of spaced apart oblong tubular holders 40 is disposed downwardly from the lid 30. The holders 40 are twistably affixed to the lid 30 such that brushes 12 may be twisted to face varying directions. This may, for example, aid in accommodating extremely large brushes 12 without brush 12 collision or damage.

Referring again to FIG. 3, a plurality of pairs of orifices 42 is disposed in each tubular holder 40. Each pair of orifices 42 is diametrically opposed. A pin 44 can be removably inserted within a given pair of orifices 42 within each tubular holder 40. A hole 15 in a handle 14 of an existing paint brush 12 is removably held by one pin 44 within a given tubular holder 40. The paint brush 12 is disposed at a selected height within one of the tubular holders 40 upon the insertion of the pin 44 through the hole 15 in the handle 14.

Figure 6:
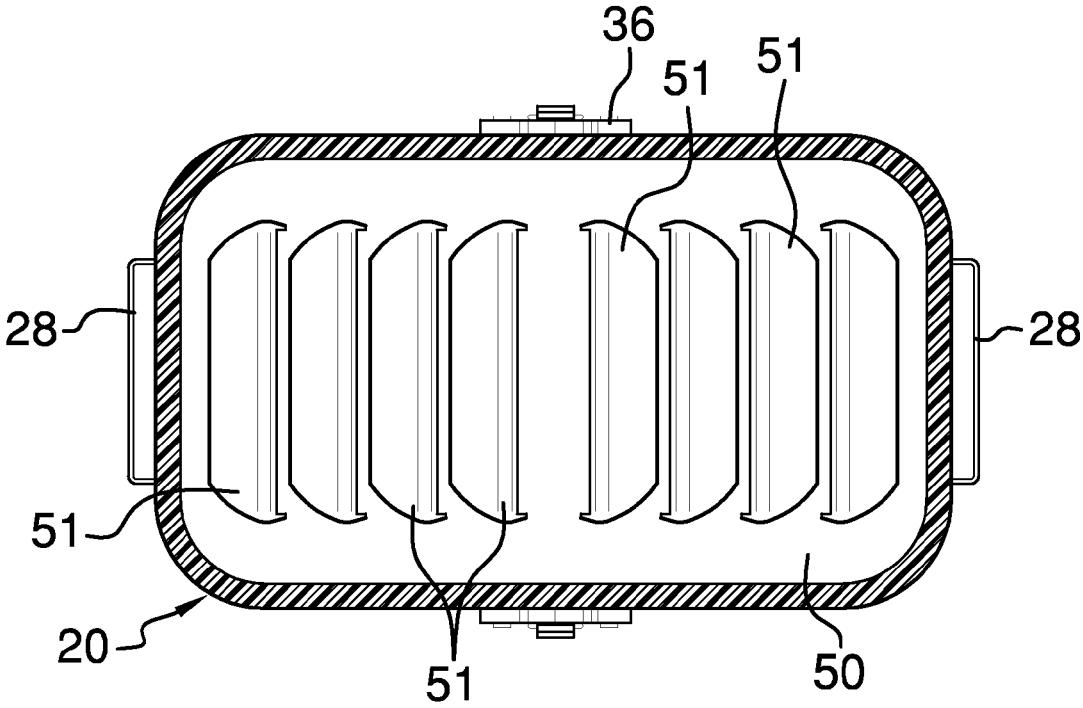
FIG. 6 is a cross sectional view of FIG. 5, taken along the line 6-6.

Referring to FIG. 6, the removable tray 50 is disposed within the pail 20 proximal to the bottom 26. The plurality of spaced apart tray vents 51 is disposed in the removable tray 50. The tray vents 51 are arranged from proximal to the first side 21 to proximal to the second side 22.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the paint brush cleaning and carrying device may be used.

What is claimed is:

1. A paint brush cleaning and carrying device comprising, in combination:

a transparent pail having a first side spaced apart from a second side, a first end spaced apart from a second end, and an open top spaced apart from a closed bottom;

a drain disposed adjacent to the bottom of the pail;

a plurality of horizontal parallel vents disposed in each of the sides and in each of the ends;

a lid removably fitted atop the pail;

a lip extended around the lid;

a seal disposed around an interior perimeter of the lip;

a lid latch disposed on the pail and on each of a lid first side and a lid second side;

a plurality of spaced apart tubular holders disposed downwardly from the lid;

a plurality of pairs of orifices disposed within in each holder, each pair diametrically opposed;

a pin removably inserted within a given pair of orifices within each tubular holder;

whereby a hole in a handle of an existing paint brush is removably held by one pin within a given tubular holder.

2. The device according to claim 1 wherein the paint brush is disposed at a selected height within one of the tubular holders upon the insertion of the pin through the hole in the handle.

3. The device according to claim 2 further comprising a handle recess disposed substantially centrally within a top of the lid, the handle recess slightly offset toward the first side;

a pivotal handle disposed within the handle recess.

4. The device according to claim 3 wherein the plurality of spaced apart tubular holders disposed downwardly from the lid further comprise oblong tubular holders.

5. The device according to claim 2 wherein the plurality of spaced apart tubular holders disposed downwardly from the lid further comprise oblong tubular holders.

6. The device according to claim 1 further comprising a handle recess disposed substantially centrally within a top of the lid, the handle recess slightly offset toward the first side; and a pivotal handle disposed within the handle recess.

7. The device according to claim 6 wherein the plurality of spaced apart tubular holders disposed downwardly from the lid further comprise oblong tubular holders.

8. The device according to claim 1 wherein the plurality of spaced apart tubular holders disposed downwardly from the lid further comprise oblong tubular holders.

9. A paint brush cleaning and carrying device comprising, in combination:

a transparent pail having a first side spaced apart from a second side, a first end spaced apart from a second end, and an open top spaced apart from a closed bottom;

a drain disposed adjacent to the bottom of the pail;

a plurality of horizontal parallel vents disposed in each of the sides and in each of the ends;

a lid removably fitted atop the pail;

a lip extended around the lid;

a handle recess disposed substantially centrally within a top of the lid, the handle recess slightly offset toward the first side;

a pivotal handle disposed within the handle recess, the handle pivoted upwardly to a fully central position upon and above the lid;

a seal disposed around an interior perimeter of the lip;

a lid latch disposed on the pail and on each of a lid first side and a lid second side;

a plurality of spaced apart oblong tubular holders disposed downwardly from the lid, the holders twistably affixed to the lid;

a plurality of pairs of orifices disposed in each holder, each pair diametrically opposed;

a pin removably inserted within a given pair of orifices within each tubular holder;

whereby a hole in a handle of an existing paint brush is removably held by one pin within a given tubular holder;

a removable tray disposed within the pail proximal to the bottom;

a plurality of spaced apart tray vents disposed in the removable tray, the tray vents arranged from proximal to the first side to proximal to the second side.

* * * * *